US011262112B2

(12) United States Patent
Karkhanis et al.

(10) Patent No.: US 11,262,112 B2
(45) Date of Patent: Mar. 1, 2022

(54) CONDENSER COIL ARRANGEMENT

(71) Applicant: Johnson Controls Technology Company, Auburn Hills, MI (US)

(72) Inventors: Rajiv K. Karkhanis, York, PA (US); Nicholas P. Mislak, Bel Air, MD (US)

(73) Assignee: Johnson Controls Technology Company, Auburn Hills, MI (US)

( * ) Notice: Subject to any disclaimer, the term of this patent is extended or adjusted under 35 U.S.C. 154(b) by 122 days.

(21) Appl. No.: 16/700,668

(22) Filed: Dec. 2, 2019

(65) Prior Publication Data

US 2021/0164710 A1 Jun. 3, 2021

(51) Int. Cl.
*F25B 39/04* (2006.01)

(52) U.S. Cl.
CPC ..... *F25B 39/04* (2013.01); *F25B 2339/04* (2013.01)

(58) Field of Classification Search
CPC ..... F25B 39/04; F25B 2339/04; F25B 6/02
See application file for complete search history.

(56) References Cited

U.S. PATENT DOCUMENTS 3,529,432 A * 9/1970 Nussbaum ..... F25B 6/02 62/196.3
10,119,730 B2 11/2018 Lin
10,247,440 B2 4/2019 Tanaka
2011/0126581 A1 6/2011 Cho et al.
2011/0192188 A1* 8/2011 Nickey ..... F28B 1/06 62/507
2015/0159920 A1 6/2015 Ha et al.
2015/0300744 A1* 10/2015 Goel ..... F28F 9/262 165/166
2017/0122630 A1 5/2017 Okazaki
2018/0135900 A1* 5/2018 Jindou ..... F25B 39/00
2019/0137148 A1 5/2019 Matsuda et al.
2019/0337359 A1* 11/2019 Toyama ..... B60H 1/00335

FOREIGN PATENT DOCUMENTS

JP 2010261642 A * 11/2010
WO 2018047331 3/2018

OTHER PUBLICATIONS

Translation JP-2010261642-A.*

* cited by examiner

*Primary Examiner* — Elizabeth J Martin
(74) *Attorney, Agent, or Firm* — Fletcher Yoder, P.C.

(57) ABSTRACT

A heating, ventilation, and/or air conditioning (HVAC) system includes an air flow path through which an air flow is routed. The HVAC system also includes a first condenser coil positioned in the air flow path and configured to receive a first portion of a refrigerant from a refrigerant conduit. The HVAC system also includes a second condenser coil positioned in the air flow path downstream from the first condenser coil relative to the air flow, and configured to receive a second portion of the refrigerant from the refrigerant conduit in parallel with the first portion of the refrigerant received by the first condenser coil.

20 Claims, 9 Drawing Sheets

CONDENSER COIL ARRANGEMENT

BACKGROUND

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

HVAC systems are utilized in residential, commercial, and industrial environments to control environmental properties, such as temperature and humidity, for occupants of the respective environments. The HVAC system may control the environmental properties through the control of an air flow delivered to the conditioned environment. For example, the HVAC system may include a condenser used to cool and condense a gaseous refrigerant. The gaseous refrigerant may be routed through condenser coils of the condenser, and an air flow over the condenser coils may extract heat from the gaseous refrigerant passing through the condenser coils, thereby converting the gaseous refrigerant to a liquid state. Unfortunately, traditional condensers may include coil arrangements that are inefficient for heat exchange.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

The present disclosure relates to a heating, ventilation, and/or air conditioning (HVAC) system that includes an air flow path through which an air flow is routed. The HVAC system also includes a first condenser coil positioned in the air flow path and configured to receive a first portion of a refrigerant from a refrigerant conduit. The HVAC system also includes a second condenser coil positioned in the air flow path downstream from the first condenser coil relative to the air flow, and configured to receive a second portion of the refrigerant from the refrigerant conduit in parallel with the first portion of the refrigerant received by the first condenser coil.

The present disclosure also relates to a condenser that includes a first condenser coil configured to receive a first portion of a refrigerant from a main refrigerant circuit, and a second condenser coil configured to receive a second portion of the refrigerant from the main refrigerant circuit in parallel with the first portion of the refrigerant received by the first condenser coil from the main refrigerant circuit. The second condenser coil is disposed downstream from the first condenser coil relative to a direction of an air flow across the condenser.

The present disclosure also relates to a condenser that includes a first condenser coil configured to receive a first portion of a refrigerant from a refrigerant conduit, and a second condenser coil configured to receive a second portion of the refrigerant from the refrigerant conduit in parallel with the first portion of the refrigerant received by the first condenser coil. The first condenser coil includes a first coil length and the second condenser coil includes a second coil length, and wherein the second coil length is between 1% and 50% of the first coil length.

DETAILED DESCRIPTION

Figure 1:
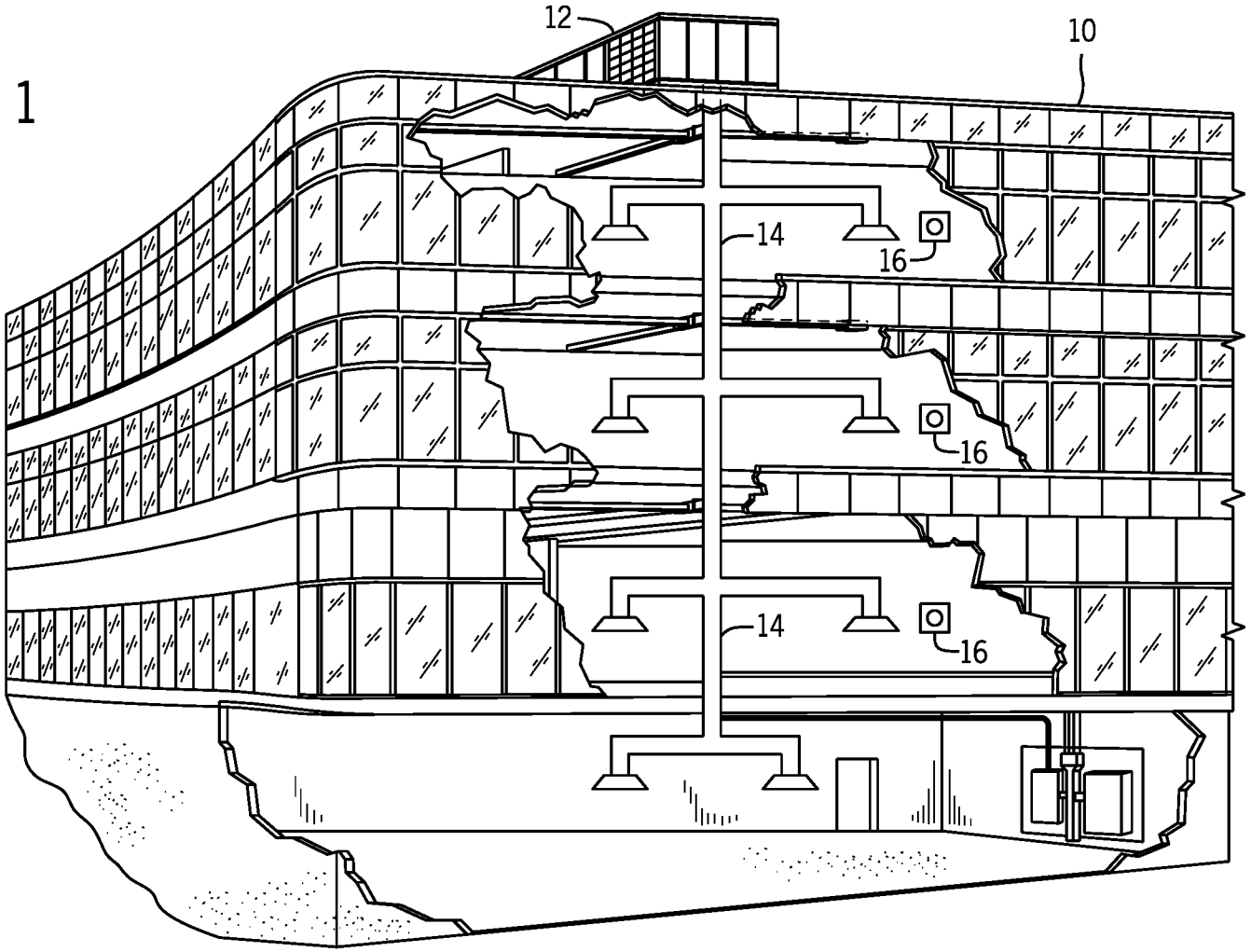
FIG. 1 is a perspective view of an embodiment of a building having a heating, ventilation, and/or air conditioning (HVAC) system in a commercial setting, in accordance with an aspect of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As briefly discussed above, a heating, ventilation, and/or air conditioning (HVAC) system may include a condenser having a coil arrangement in which a first condenser coil is positioned in an air flow path, and a second condenser coil is positioned in the air flow path downstream from the first condenser coil relative to the air flow path. In one such embodiment, the first condenser coil may be configured to receive a first portion of a refrigerant from a refrigerant conduit, and the second condenser coil may be configured to receive a second portion of the refrigerant from the refrigerant conduit in parallel with the first portion of the refrigerant received by the first condenser coil. The first condenser coil may be a two-pass condenser coil, and the second condenser coil may be sized to align with one of the passes of the first condenser coil, such as the second pass. For example, the first pass of the first condenser coil generally may be utilized to desuperheat and condense the first portion of the refrigerant, and the second pass of the first condenser coil generally may be utilized to subcool the first portion of the refrigerant. The portion of the air flow over the first pass may receive more heat than the portion of the air flow over the second pass. By positioning and sizing the second condenser coil to align with the second pass of the first condenser coil, the second portion of the refrigerant passing through the second condenser coil may extract additional heat from the portion of the air flow that passed over the second pass of the first condenser coil, thereby improving efficiency of the condenser and causing more uniform heat distribution through the air flow passing over the condenser. Other condenser coil arrangements are also disclosed for improving efficiency of the condenser and causing more uniform heat distribution through the air flow passing over the condenser, and will be described in detail below.

Turning now to the drawings, FIG. 1 illustrates an embodiment of a heating, ventilation, and/or air conditioning (HVAC) system for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
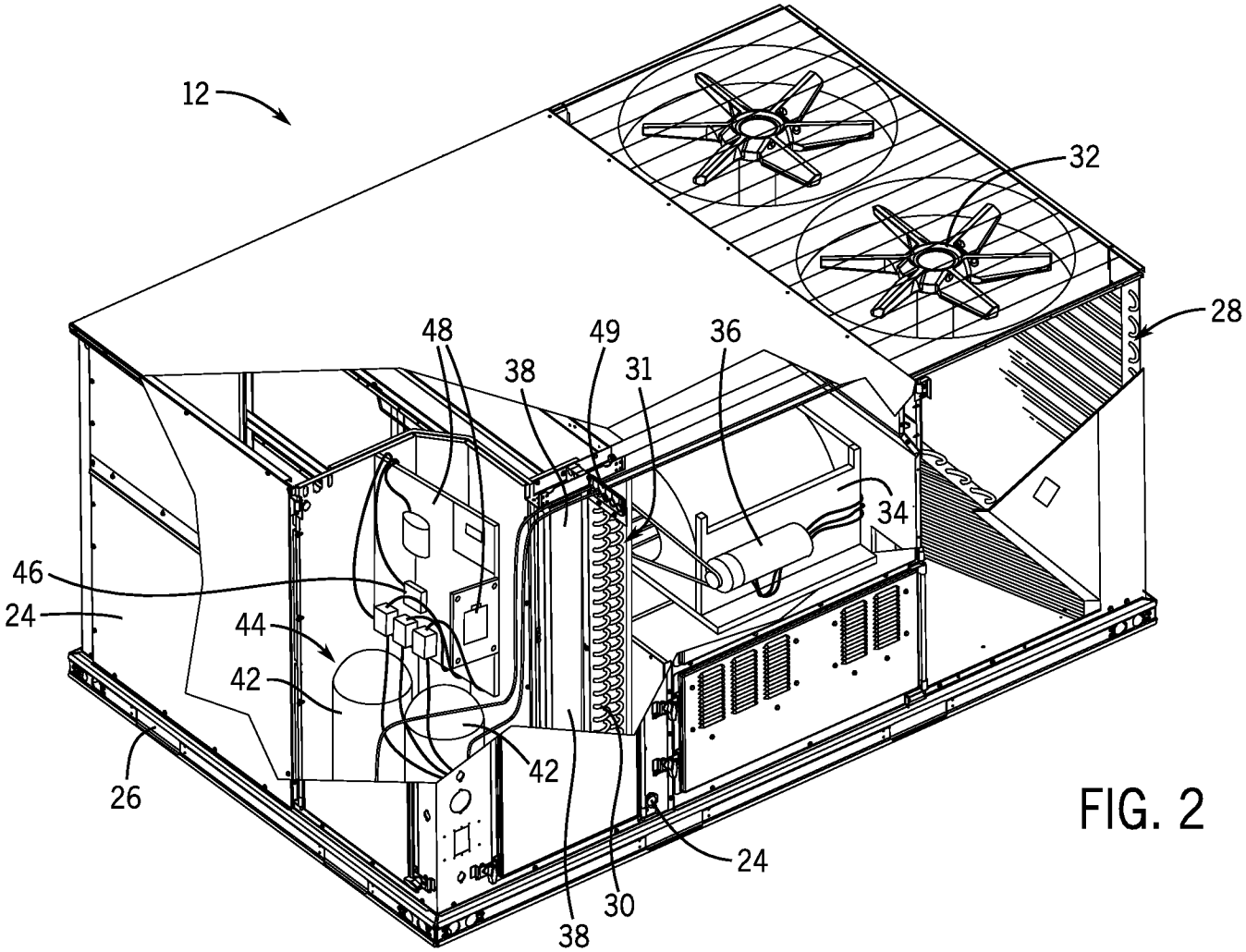
FIG. 2 is a perspective view of an embodiment of a packaged HVAC unit, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits.

Tubes within the heat exchangers 28 and 30 may circulate refrigerant, such as R-410A, through the heat exchangers 28 and 30. The tubes may be of various types, such as multi-channel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the HVAC unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
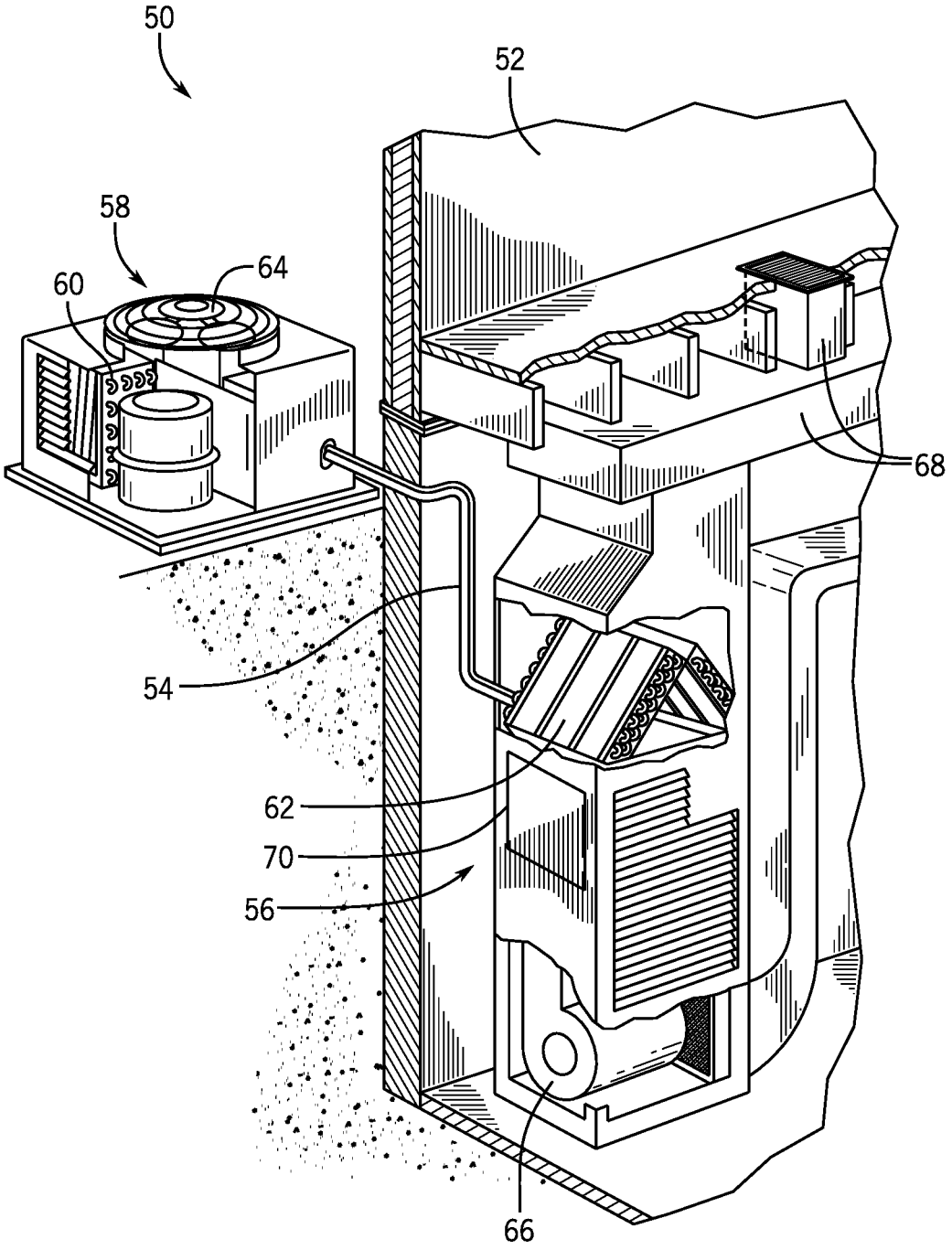
FIG. 3 is a perspective view of an embodiment of a split, residential HVAC system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit 56 functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or a set point plus a small amount, the residential heating and cooling system 50 may become operative to refrigerate additional air for circulation through the residence 52. When the temperature reaches the set point, or a set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over outdoor the heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace system 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
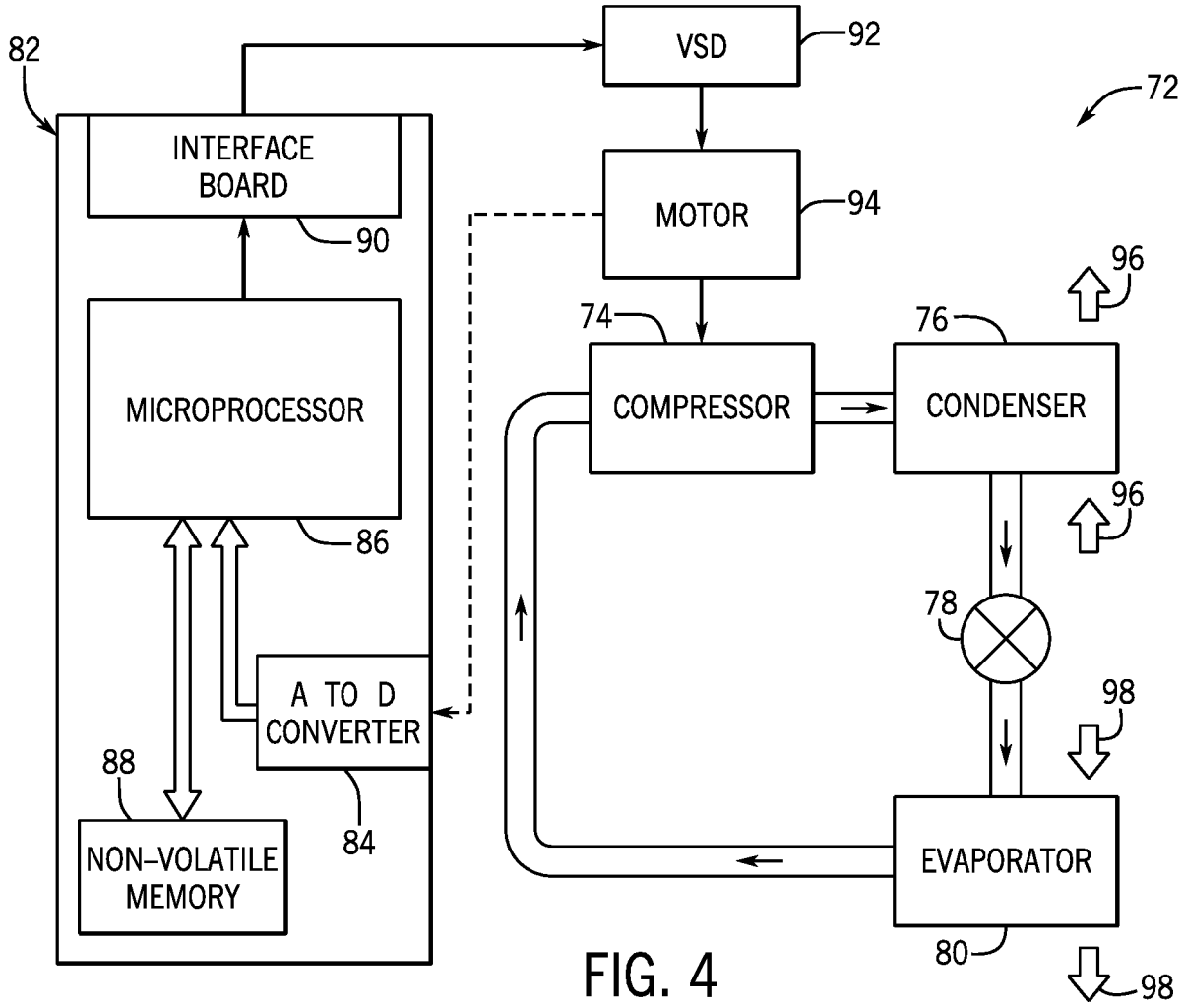
FIG. 4 is a schematic diagram of an embodiment of a vapor compression system used in an HVAC system, in accordance with an aspect of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

Further, any of the preceding embodiments illustrated in FIGS. 1-4 may include a condenser having a coil arrangement in which a first condenser coil is positioned in the air flow path, and a second condenser coil is positioned in the air flow path downstream from the first condenser coil relative to the air flow path. For example, in accordance with present embodiments, any of the heat exchangers 28, 30, 60, 76 illustrated in FIGS. 1-4 (including any heat exchangers associated with the HVAC unit 12 of FIG. 1) may include the presently disclosed condenser(s) described in detail below, and with reference to FIGS. 5-10.

In one embodiment, the first condenser coil of the condenser (such as heat exchanger 28, 30, 60, or 76 in FIGS. 1-4) is configured to receive a first portion of a refrigerant from a refrigerant conduit, and the second condenser coil of the condenser (such as heat exchanger 28, 30, 60, or 76 in FIGS. 1-4) is configured to receive a second portion of the refrigerant from the refrigerant conduit in parallel with the first portion of the refrigerant received by the first condenser coil. The first condenser coil may be a two-pass condenser coil, and the second condenser coil may be sized to align with one of the passes of the first condenser coil, such as the second pass. For example, the first pass of the first condenser coil may be utilized to desuperheat and condense the first portion of the refrigerant, and the second pass of the first condenser coil may be utilized to subcool the first portion of the refrigerant. The portion of the air flow over the first pass may receive more heat than the portion of the air flow over the second pass. By positioning and sizing the second condenser coil to align with the second pass of the first condenser coil, the refrigerant passing through the second condenser coil may extract additional heat from the portion of the air flow that passed over the second pass of the first condenser coil, thereby improving efficiency of the condenser (such as heat exchanger 28, 30, 60, or 76 in FIGS. 1-4) and causing more uniform heat distribution through the air flow passing over the condenser. Other condenser coil arrangements are also possible, and will be described in detail below. For ease of illustration and description, reference numeral 100 will denote the condensers described below with respect to FIGS. 5-8, and reference numeral 200 will denote the condensers described below with reference to FIGS. 9 and 10. That is, heat exchangers 28, 30, 60, 76 illustrated in FIGS. 1-4 (including any heat exchangers associated with the HVAC unit 12 of FIG. 1) may correspond to condensers 100 and 200 described below with reference to FIGS. 5-10.

Figure 5:
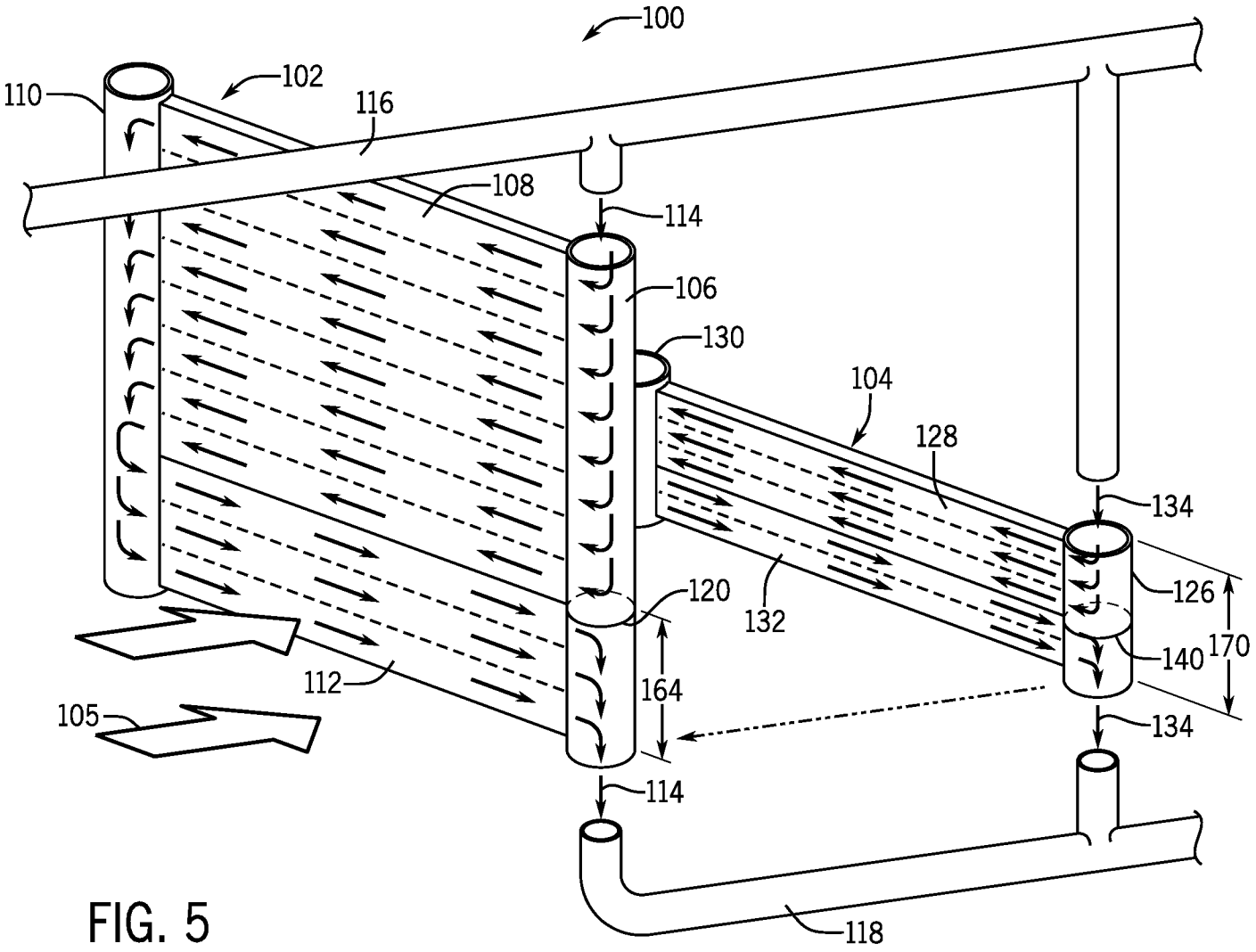
FIG. 5 is an exploded schematic perspective view of a condenser coil arrangement for a condenser, in accordance with an aspect of the present disclosure.

With the foregoing in mind, FIG. 5 is an exploded schematic perspective view of an embodiment of a condenser coil arrangement for a condenser 100. In some embodiments, the illustrated condenser 100 may correspond to one of two legs forming a V-shape of the condenser, such as a V-shaped condenser included in a condenser section of a rooftop unit (RTU) or outdoor unit. In other embodiments, the illustrated condenser 100 may correspond to the entire condenser, such as a multi-channel or other heat exchanger included in an HVAC system of a residency. It should also be noted that illustrated condenser 100 may be oriented in an HVAC system in any direction. In other words, the illustrated condenser 100 should not be taken as oriented in any particular direction with respect to a Gravity vector.

In the illustrated embodiment, the condenser 100 includes a first condenser coil 102 and a second condenser coil 104 disposed downstream from the first condenser coil 102 with respect to an air flow 105 through the condenser 100. The first condenser coil 102 may include an inlet/outlet header 106, a first refrigerant pass 108, a transfer header 110, and a second refrigerant pass 112 in counter-flow with the first refrigerant pass 108.

The inlet/outlet header 106 may receive a first refrigerant portion 114 from a refrigerant feed-line 116 that feeds refrigerant to the condenser 100 from, for example, a compressor (not shown). After receiving the first refrigerant portion 114 from the refrigerant feed-line 116, the inlet/outlet header 106 may distribute the first refrigerant portion 114 to multiple condenser tubes forming the first refrigerant pass 108. The multiple condenser tubes are schematic in the illustrated embodiment and may include singular tubes, multi-channel tubes, or any other suitable condenser tubes. The transfer header 110 may receive the first refrigerant portion 114 from the first refrigerant pass 108 and may transfer, or distribute, the first refrigerant portion 114 from the first refrigerant pass 108 of the first condenser coil 102 to multiple condenser tubes of the second refrigerant pass 112 of the first condenser coil 102. The multiple condenser tubes are schematic in the illustrated embodiment and may include singular tubes, multi-channel tubes, or any other suitable condenser tubes. The first refrigerant portion 114 may then be received by the inlet/outlet header 106 and output to a refrigerant output line 118. A baffle 120 may be disposed in the inlet/outlet header 106 to separate an inlet portion of the inlet/outlet header 106, or the portion of the inlet/outlet header 106 receiving the first refrigerant portion 114 from the refrigerant feed-line 116, from the outlet portion of the inlet/outlet header 106, or the portion of the inlet/outlet header 106 outputting the first refrigerant portion 114 from the inlet/outlet header 106 to the refrigerant output line 118. In certain embodiments, the first refrigerant pass 108 of the first condenser coil 102 may be generally utilized to desuperheat and condense the first refrigerant portion 114, whereas the second refrigerant pass 112 of the first condenser coil 102 may be generally utilized to subcool the first refrigerant portion 114. Because of these differences between the first refrigerant pass 108 and the second refrigerant pass 112, more heat may be extracted by the portion of the air flow 105 passing over the first refrigerant pass 108 than over the second refrigerant pass 112.

In accordance with present embodiments, the second condenser coil 104 may be positioned downstream from the first condenser coil 102 relative to an air flow direction of the air flow 105. That is, the second condenser coil 104 may be disposed in series with the first condenser coil 102 with respect to the air flow 105. Thus, the air flow 105 may pass over the first condenser coil 102, and then may pass over the second condenser coil 104. The first condenser coil 102 and the second condenser coil 104 are illustrated in a spaced arrangement due to the exploded perspective view, but it should be appreciated that the first condenser coil 102 and the second condenser coil 104 may contact each other and/or may be positioned immediately adjacent to each other.

The second condenser coil 104 in the illustrated embodiment includes an inlet/outlet header 126, a first refrigerant pass 128, a transfer header 130, and a second refrigerant pass 132 in counter-flow with the first refrigerant pass 128. The inlet/outlet header 126 of the second condenser coil 104 may receive a second refrigerant portion 134 from the refrigerant feed-line 116 in parallel with the first refrigerant portion 114 received by the first condenser coil 102 from the refrigerant feed-line 116. That is, while the second condenser coil 104 is disposed downstream from the first condenser coil 102 with respect to the air flow 105, the second condenser coil 104 and the first condenser coil 102 are disposed in parallel with each other relative to the refrigerant input from the refrigerant feed-line 116.

After receiving the second refrigerant portion 134 from the refrigerant feed-line 116, the inlet/outlet header 126 of the second condenser coil 104 may distribute the second refrigerant portion 134 to multiple condenser tubes forming the first refrigerant pass 128 of the second condenser coil 104. The multiple condenser tubes are schematic in the illustrated embodiment and may include singular tubes, multi-channel tubes, or any other suitable condenser tubes. The transfer header 130 may receive the second refrigerant portion 134 from the first refrigerant pass 128 of the second condenser coil 104 and may transfer, or distribute, the second refrigerant portion 134 from the first refrigerant pass 128 of the second condenser coil 104 to multiple condenser tubes of the second refrigerant pass 132 of the second condenser coil 104. The multiple condenser tubes are schematic in the illustrated embodiment and may include singular tubes, multi-channel tubes, or any other suitable condenser tubes. The second refrigerant portion 134 may then be received by the inlet/outlet header 126 and output to the refrigerant output line 118. In the illustrated embodiment, the refrigerant output line 118 combines the first refrigerant portion 114 received from the first condenser coil 102 and the second refrigerant portion 134 received from the second condenser coil 104. A baffle 140 may be disposed in the inlet/outlet header 126 of the second condenser coil 104 to separate an inlet portion of the inlet/outlet header 126, or the portion of the inlet/outlet header 126 receiving the second refrigerant portion 134 from the refrigerant feed-line 116, from the outlet portion of the inlet/outlet header 126, or the portion of the inlet/outlet header 126 outputting the second refrigerant portion 134 from the inlet/outlet header 126 to the refrigerant output line 118. In certain embodiments, the first refrigerant pass 128 of the second condenser coil 104 may be generally utilized to desuperheat and condense the second refrigerant portion 134, whereas the second refrigerant pass 132 of the second condenser coil 104 may be generally utilized to subcool the second refrigerant portion 134.

Figure 6:
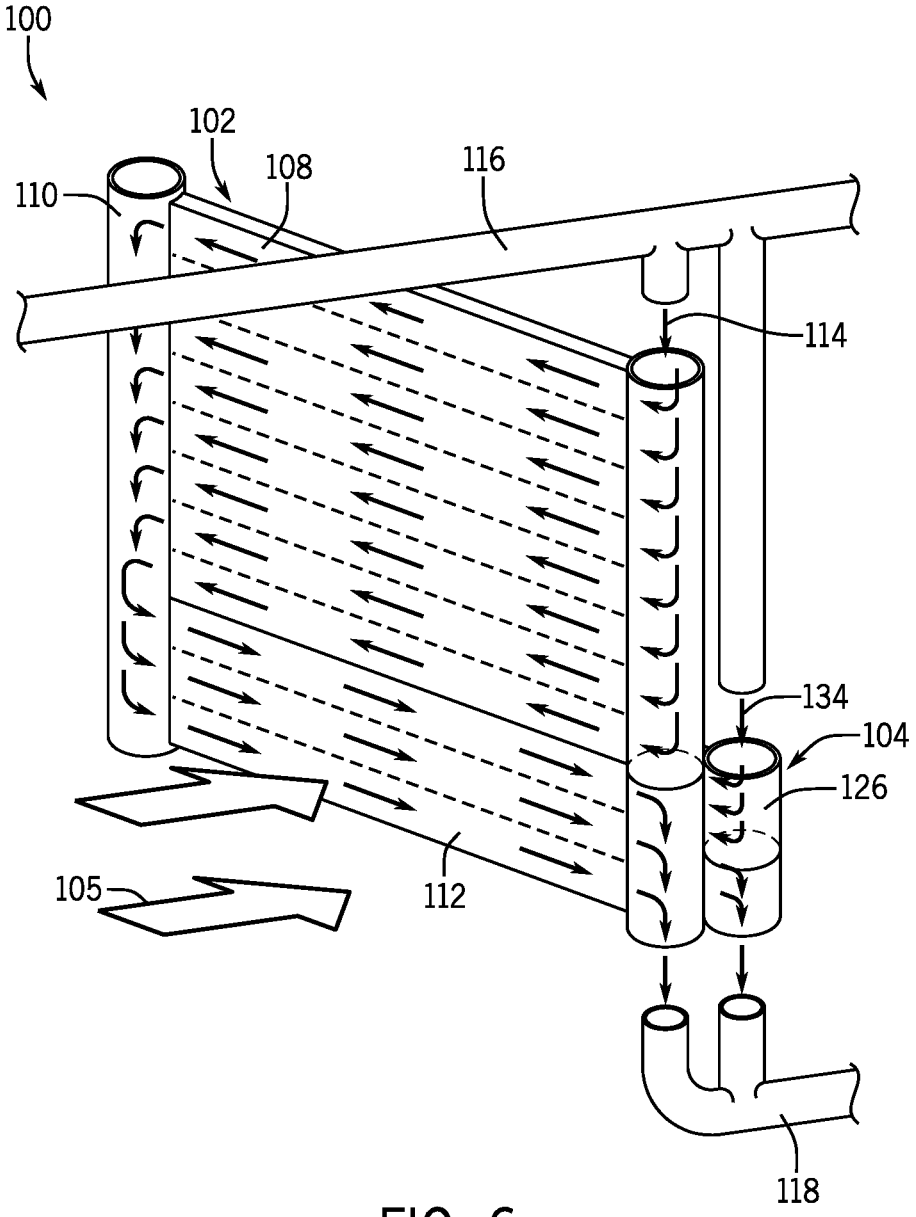
FIG. 6 is a schematic perspective view of the condenser coil arrangement for the condenser in FIG. 5, in accordance with an aspect of the present disclosure.

As shown, the second condenser coil 104 may be sized and arranged to align with the second refrigerant pass 112 of the first condenser coil 102. For example, as shown, a length 150 of the second refrigerant pass 112 of the first condenser coil 102 may be substantially similar to a total length 170 of the second condenser coil 104. Additionally or alternatively, an amount of tubing in the second refrigerant pass 112 of the first condenser coil 102 may be substantially similar to an amount of tubing in the second condenser coil 104. Relative sizing of the first condenser coil 102 and the second condenser coil 104 will be described in detail below with respect to FIGS. 7 and 8. FIG. 6 is a perspective view of the condenser coil arrangement of FIG. 5, where the second condenser coil 104 is disposed immediately adjacent to the first condenser coil 102.

Figure 7:
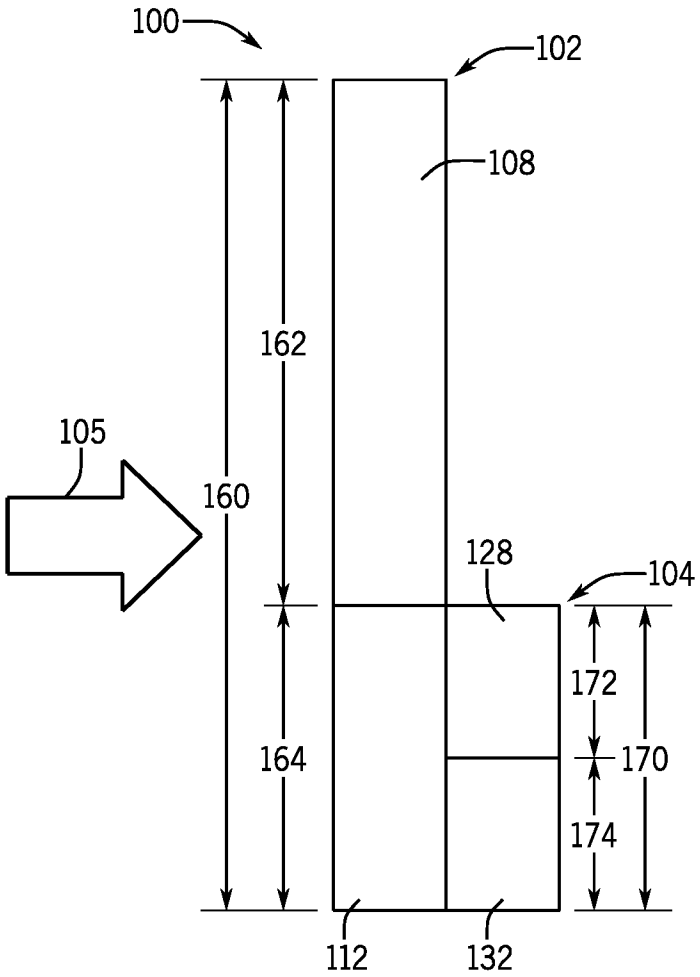
FIG. 7 is a schematic side view of the condenser coil arrangement for the condenser in FIG. 5, in accordance with an aspect of the present disclosure.

FIG. 7 is a schematic side view of the condenser coil arrangement for the condenser 100 in FIG. 5. For purposes of illustrating a relative sizing of the various passes of the first condenser coil 102 and the second condenser coil 104, the headers of the condenser coils 102, 104 are not illustrated. FIG. 7 is schematic and should not be taken as representing all components of the condenser coils 102, 104.

Each of the condenser coils 102, 104 is a two-pass coil. For example, the first condenser coil 102 includes the first refrigerant pass 108 and the second refrigerant pass 112, and the second condenser coil 104 includes the first refrigerant pass 128 and the second refrigerant pass 132. The first condenser coil 102 includes a total length 160. A length 162 of the first refrigerant pass 108 plus a length 164 of the second refrigerant pass 112 may be substantially similar to the total length 160 of the first condenser coil 102. In some embodiments, the length 162 may be approximately 55%-85% of the length 160, and the length 164 may be approximately 15%-45% of the length 160. In some embodiments, the length 162 may be approximately 60%-80% of the length 160, and the length 164 may be approximately 20%-40% of the length 160. In some embodiments, the length 162 may be approximately 65%-75% of the length 160, and the length 164 may be approximately 25%-35% of the length 160. For example, the length 162 of the first refrigerant pass 108 of the first condenser coil 102 may be approximately 70% of the total length 160 of the first condenser coil 102, and the length 164 of the second refrigerant pass 112 of the first condenser coil 102 may be approximately 30% of the total length 160 of the first condenser coil 102.

It should be noted that the term "length" should not be interpreted to necessarily imply a relative orientation of the first condenser coil 102 with respect to a Gravity vector, but instead is used merely to denote relative sizing of the various components of the first condenser coil 102. Further, in some embodiments, the relative sizing of the first refrigerant pass 108 and the second refrigerant pass 112 may be in terms of amount of tubing or tubing volume. "Amount of tubing" may be used herein to refer to a total distance of tubing if the tubing were laid out in a straight line and without curvature. "Volume of tubing" may be used herein to refer to a total combined volume of refrigerant flow path defined by the tubing. In some embodiments, an amount or volume of tubing of the first refrigerant pass 108 may account for approximately 55%-85% of a total amount or volume of tubing of the first condenser coil 102, and an amount or volume of tubing for the second refrigerant pass 112 may account for approximately 15%-45% of the a total amount or volume of tubing of the first condenser coil 102. In some embodiments, the amount or volume of tubing of the first refrigerant pass 108 may account for approximately 60%-80% of the total amount or volume of the first condenser coil 102, and the amount or volume of tubing of the second refrigerant pass 112 may be approximately 20%-40% of the total amount or volume of tubing of the first condenser coil 102. In some embodiments, the amount or volume of tubing of the first refrigerant pass 108 may account for approximately 75%-65% of the total amount or volume of the first condenser coil 102, and the amount or volume of tubing of the second refrigerant pass 112 may be approximately 25%-35% of the total amount or volume of tubing of the first condenser coil 102. For example, the amount or volume of tubing of the first refrigerant pass 108 may account for approximately 70% of the total amount or volume of tubing of the first condenser coil 102, and the amount or volume of tubing of the second refrigerant pass 112 may account for approximately 30% of the total amount or volume of tubing of the first condenser coil 102.

As previously described, the first refrigerant pass 108 of the first condenser coil 102 may be generally utilized to desuperheat and condense the first refrigerant portion 114, and the second refrigerant pass 112 of the first condenser coil 102 may be generally utilized to subcool the first refrigerant portion 114. Because of these differences between the first refrigerant pass 108 and the second refrigerant pass 112, more heat may be extracted by the portion of the air flow 105 passing over the first refrigerant pass 108 than over the second refrigerant pass 112. Thus, in accordance with present embodiments, the second condenser coil 104 of the condenser 100 may be positioned downstream, relative to an air flow direction of the air flow 105, from the first condenser coil 102.

The second condenser coil 104 may include a total length 170 that is substantially similar to the length 164 of the second refrigerant pass 112 of the first condenser coil 102. Thus, based on the relative lengths 162, 164 of the first and second refrigerant passes 108, 112, respectively, of the first condenser coil 102, the total length 170 of the second condenser coil 104 may be, for example, between approximately 1% and 50% of the total length 160 of the first condenser coil 102, or between approximately 1% and 35% of the total length 160 of the first condenser coil 102. In this way, the portion of the air flow 105 passing over or through the second refrigerant pass 112 of the first condenser coil 102 will substantially pass over or through the second condenser coil 104, and the portion of the air flow 105 passing over or through the first refrigerant pass 108 of the first condenser coil 102 will not substantially pass over or through the second condenser coil 104. As noted above, the relative sizing of the second condenser coil 104 relative to aspects of the first condenser coil 102 may be determined in terms of something other than length. For example, the relative sizing of the second condenser coil 104 compared to the second refrigerant pass 112 of the first condenser coil 102 may be in terms of amount or volume of tubing. That is, the amount or volume of tubing of the second refrigerant pass 112 of the first condenser coil 102 may be substantially similar or equal to the total amount or volume of tubing of the second condenser coil 104. Further, the sizing of the second condenser coil 104 and the second refrigerant pass 112 of the first condenser coil 102 may differ slightly in accordance with presently contemplated embodiments. For example, a coil size of the second refrigerant pass 112 of the first condenser coil 102 may be within +/−10% of a total coil size of the second condenser coil 104. In other words, the coil size of the second refrigerant pass 112 of the first condenser coil 102 may be between 90%-110% of the coil size of the second condenser coil 104. "Coil size" may be used herein to refer to any of the above-described coil lengths, volume of tubing, or amount of tubing. "Tubing" and "coil" may be used interchangeably.

By sizing the second condenser coil 104 relative to, or substantially similar to, the second refrigerant pass 112 of the first condenser coil 102, the heat rejection by refrigerant of the corresponding HVAC system to the air flow 105 is improved and may be more efficient than traditional embodiments. Further, heat distribution through the air flow 105 is improved and more uniform than traditional embodiments. It should be noted that the second condenser coil 104 may be a two-pass coil, like the first condenser coil 102, and that relative lengths 172, 174 of the first refrigerant pass 128 of the second condenser coil 104 and the second refrigerant pass 132 of the second condenser coil 104 may be substantially similar to those described above for the first condenser coil 102.

Figure 8:
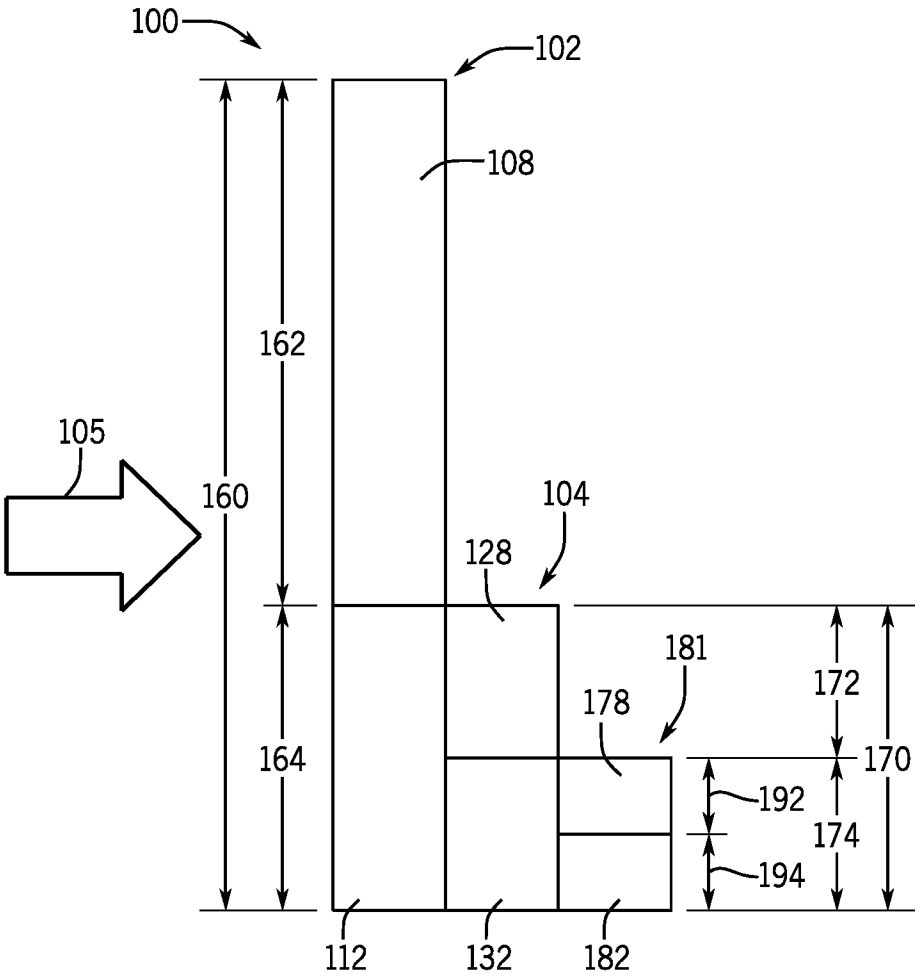
FIG. 8 is a schematic side view of another condenser coil arrangement for a condenser, in accordance with an aspect of the present disclosure.

FIG. 8 is a side view of another embodiment of a condenser coil arrangement for the condenser 100. In the illustrated embodiment, the condenser 100 includes the first condenser coil 102 and the second condenser coil 104 in accordance with the description of FIG. 7 above, but also includes a third condenser coil 181 downstream from the second condenser coil 104 relative to an air flow direction of the air flow 105. The third condenser coil 181, as shown, includes a first refrigerant pass 178 and a second refrigerant pass 182. The first refrigerant pass 178 of the third condenser coil 181 includes a length 192 (or coil amount or volume) and the second refrigerant pass 182 of the third condenser coil 181 includes a length 194. The lengths 192 and 194 combine to be substantially similar to the length 174 (or coil amount or volume) of the second refrigerant pass 132 of the second refrigerant coil 104. That is, the length 174 (or coil amount or volume) of the second refrigerant pass 132 of the second refrigerant coil 104 is substantially similar to a total length (or coil amount or volume) of the third refrigerant coil 181. The relative sizing between the first refrigerant pass 178 of the third refrigerate coil 181 and the second refrigerant pass 182 of the third refrigerant coil 181 may be substantially similar to the above-described relative sizing of the first refrigerant pass 128 and the second refrigerant pass 132 of the second condenser coil 104, and of the first refrigerant pass 108 and the second refrigerant pass 112 of the first condenser coil 102. That is, the condenser 100 may include a fractal-like design with multiple condenser coils 102, 104, 181 (or more) that cascade in stages decreasing in size, each of which having similar relative sizing of the two-pass configurations therein.

Figure 9:
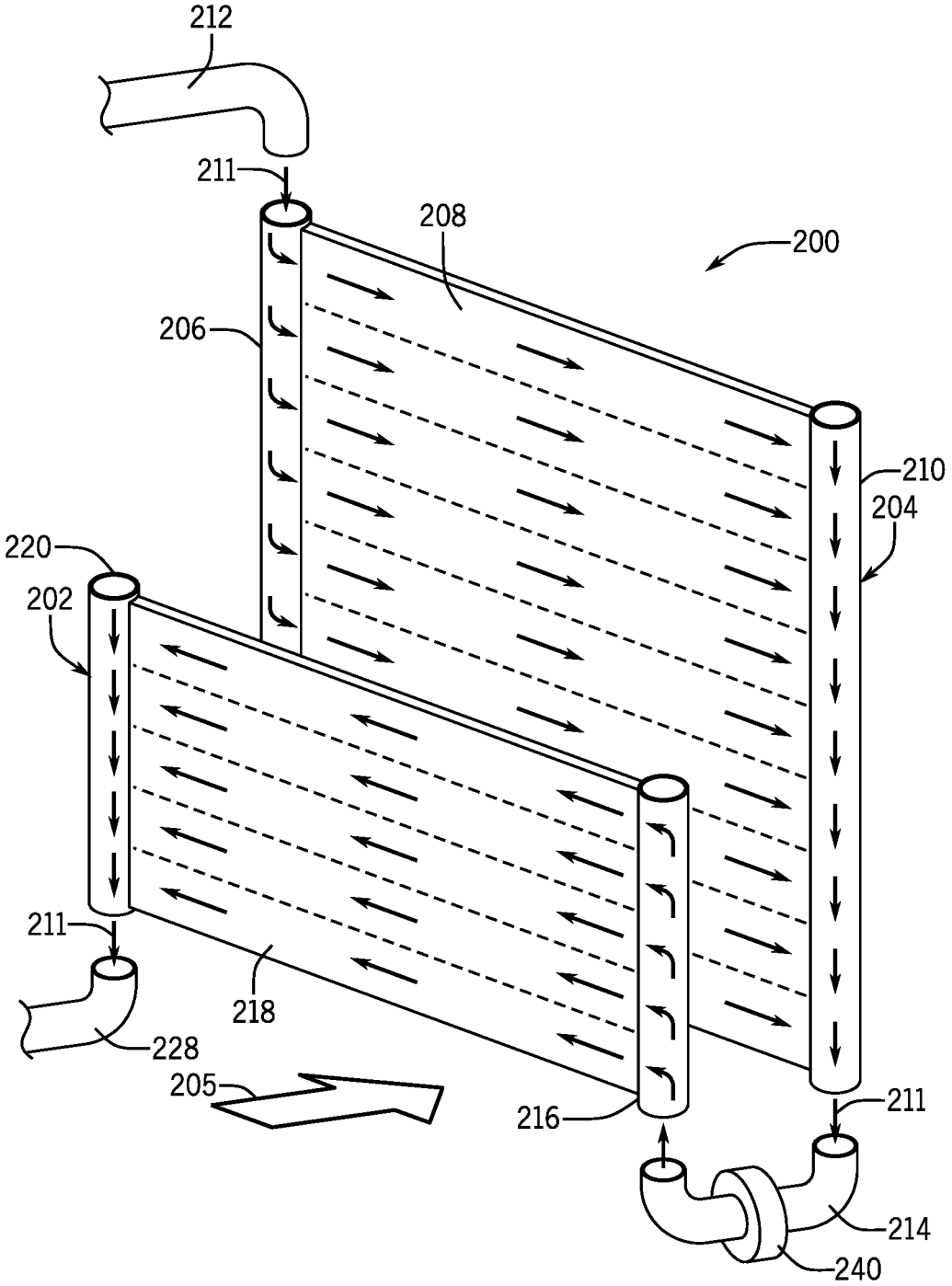
FIG. 9 is a schematic perspective view of another condenser coil arrangement for a condenser, in accordance with an aspect of the present disclosure.

FIG. 9 is a schematic perspective view of another embodiment of a condenser coil arrangement for a condenser 200, which may be incorporated in any of the HVAC systems illustrated in FIGS. 1-4. In the illustrated embodiment, the condenser 200 includes a first condenser coil 202 and a second condenser coil 204 disposed downstream from the first condenser coil 202 relative to an air flow direction of an air flow 205. In the illustrated embodiment, the first condenser coil 202 is a single-pass coil and the second condenser coil 204 is a single-pass coil.

The second condenser coil 204 in the illustrated embodiment is configured to receive a refrigerant, for example from a compressor, and pass the refrigerant to the first condenser coil 202. That is, the second condenser coil 204 and the first condenser coil 202 are in series relative to a flow of refrigerant. The second condenser coil 204 includes an inlet header 206, a number of coils or tubes 208 arranged in a single pass, and an outlet header 210. The inlet header 206 receives refrigerant 211 from a refrigerant feed-line 212, and passes the refrigerant 211 to the tubes 208 over which the air flow eventually passes. The tubes 208 pass the refrigerant 211 to the outlet header 210, which outputs the refrigerant 211 to a transfer conduit 214. The transfer conduit 214 may pass the refrigerant 211 to an inlet header 216 of the first condenser coil 202, which distributes the refrigerant 211 to a number of coils or tubes 218 arranged in a single pass. The tubes 218 guide the refrigerant 211 to an outlet header 220 of the first condenser coil 202, which outputs the refrigerant 211 to a refrigerant output line 228.

As shown, the first condenser coil 202 receives the air flow 205 prior to the second condenser coil 204 receiving the air flow 205, while the second condenser coil 204 receives the refrigerant 211 prior to the first condenser coil 202 receiving the refrigerant 211. The illustrated coil arrangement enables similar technical benefits noted above with respect to other disclosed embodiments. In particular, the disclosed coil arrangement facilitates improved heat exchange efficiency and more evenly distributes heat or temperature across the air flow 205.

It should be noted that the side of the first condenser coil 202 on which the inlet header 216 and the outlet header 220 are disposed in the illustrated embodiment could be alternated, and/or the side of the second condenser coil 204 on which the inlet header 206 and the output header 210 are disposed could be alternated. Further, the inlet headers 206, 216 may receive the refrigerant 211 on either end, and the outlet headers 210, 220 may output the refrigerant 211 on either end. In some embodiments, a pump 240 or a comparable device may be utilized to move the refrigerant 211 through the various refrigerant flow paths noted above. In the illustrated embodiment, the pump 240 is disposed on the transfer conduit 214, but may be disposed anywhere along the refrigerant flow path.

Figure 10:
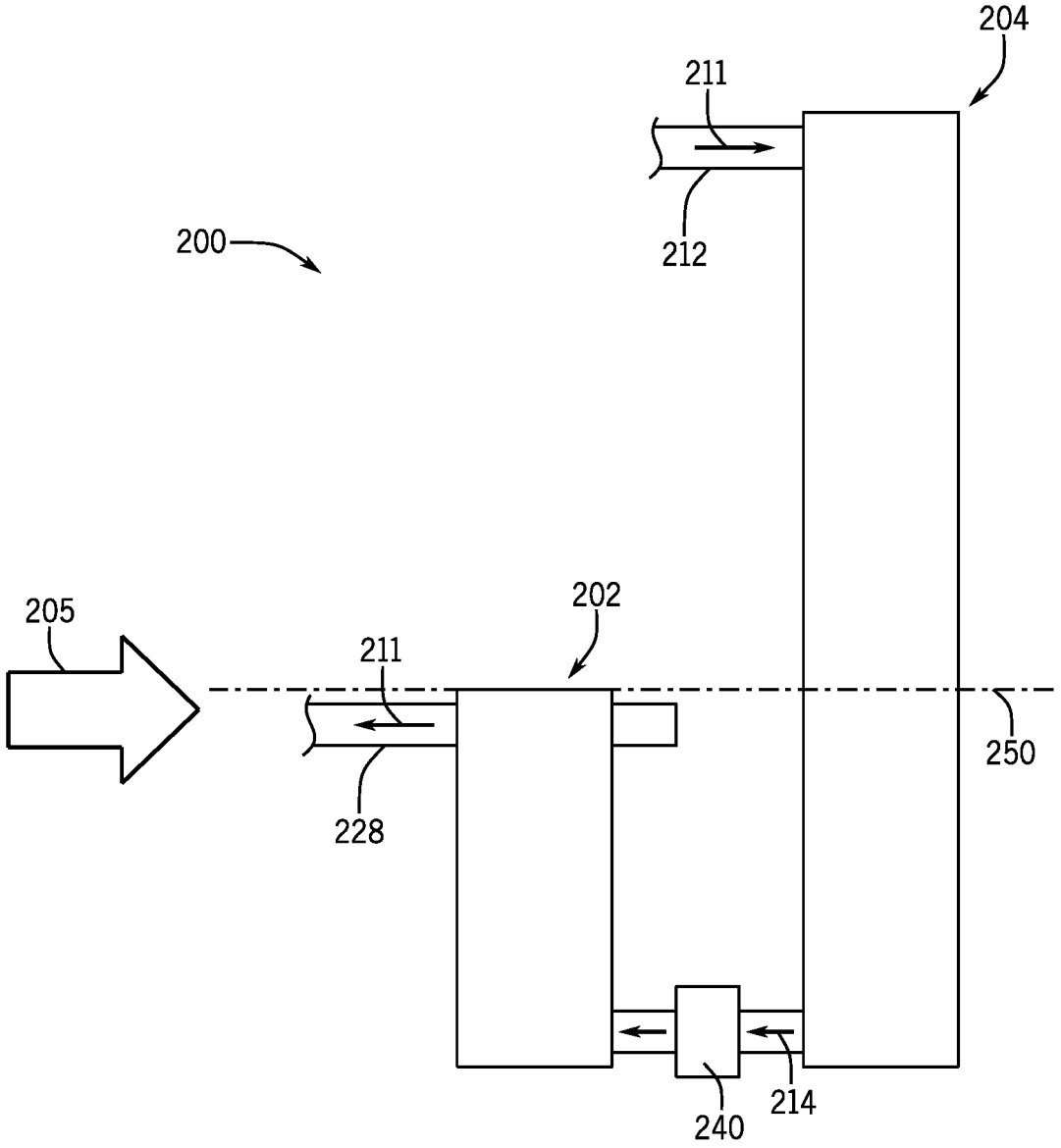
FIG. 10 is a schematic side view of the condenser coil arrangement of FIG. 9, in accordance with an aspect of the present disclosure.

FIG. 10 is a schematic side view of the condenser coil arrangement for the condenser 200 of FIG. 9. In the illustrated embodiment, the condenser 200 includes the first condenser coil 202 and the second condenser coil 204. As previously described, both the first condenser coil 202 and the second condenser coil 204 may be single-pass condensers disposed in series with respect to the air flow 205, and disposed in series with respect to the flow of the refrigerant 211. In certain embodiments, a divider wall 250, represented in the schematic illustration by a dashed line, may segment portions 252, 254 of the air flow 205. In other embodiments, the air flow 205 may flow freely toward the condenser 200 and now divider wall 250 is included. The flow of the refrigerant 211 through the second condenser coil 204, which receives the refrigerant 211 prior to the first condenser coil 202 receiving the refrigerant 211, may reject more heat to the air flow 205 adjacent the refrigerant feed-line 212 than adjacent the transfer (or outlet) conduit 214. That is, the area of the second condenser coil 204 that receives the refrigerant 211 first may better reject heat to the air flow 205 than the area of the second condenser coil 204 that receives the refrigerant 211 last. Thus, by positioning the first condenser coil 202 closer to the transfer (or outlet) conduit 214 in the illustrated embodiment, or in other words adjacent the area of the second condenser coil 204 that receives the refrigerant 211 last, than to the refrigerant feed-line 212 in the illustrated embodiment, or in other words adjacent the area of the second condenser coil 204 that receives the refrigerant 211 first, the second condenser coil 204 rejects heat from the refrigerant 211 to effectually balance the performance of the condenser 200 from top to bottom and side to side. That is, the illustrated embodiment improves heat rejection from the refrigerant 211 compared to traditional embodiments, and improves uniformity in a temperature of the air flow 205 after passing through the entirety of the condenser 200.

Technical benefits of disclosed embodiments include improved condenser heat rejection, improved condenser efficiency, and improved air flow temperature uniformity. The above-described coil arrangements of a condenser may be incorporated in a residential, commercial, or industrial environment, having the above-described technical benefits in any such settings.

While only certain features and embodiments have been illustrated and described, many modifications and changes may occur to those skilled in the art, such as variations in sizes, dimensions, structures, shapes and proportions of the various elements, values of parameters, such as temperatures and pressures, mounting arrangements, use of materials, colors, orientations, and so forth, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described, such as those unrelated to the presently contemplated best mode, or those unrelated to enablement. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A heating, ventilation, and/or air conditioning (HVAC) system, comprising:

an air flow path through which an air flow is routed;

a first condenser coil positioned in the air flow path and configured to receive a first portion of a refrigerant from a refrigerant conduit; and a second condenser coil positioned in the air flow path downstream from the first condenser coil relative to the air flow, and configured to receive a second portion of the refrigerant from the refrigerant conduit in parallel with the first portion of the refrigerant received by the first condenser coil, wherein the first condenser coil includes a first refrigerant pass and a second refrigerant pass in series with the first refrigerant pass, and wherein a coil size of the second refrigerant pass of the first condenser coil is within 10% of a total coil size of the second condenser coil.

2. The HVAC system of claim 1, wherein the first condenser coil is a two-pass condenser coil.

3. The HVAC system of claim 1, wherein the first condenser coil comprises:

the first refrigerant pass configured to desuperheat and condense the first portion of the refrigerant via heat exchange with the air flow; and the second refrigerant pass in series with the first refrigerant pass and configured to subcool the first portion of the refrigerant via heat exchange with the air flow.

4. The HVAC system of claim 3, wherein the first refrigerant pass has between 60% and 80% of an additional total coil size of the first condenser coil.

5. The HVAC system of claim 3, wherein the second refrigerant pass has between 20% and 40% of an additional total coil size of the first condenser coil.

6. The HVAC system of claim 1, wherein the second condenser coil includes a third refrigerant pass and a fourth refrigerant pass in series with the third refrigerant pass.

7. The HVAC system of claim 1, comprising a rooftop unit having a condenser that includes the first condenser coil and the second condenser coil.

8. The HVAC system of claim 1, wherein the first condenser coil includes a first multichannel condenser coil and the second condenser coil includes a second multichannel condenser coil.

9. A condenser, comprising:

a first condenser coil configured to receive a first portion of a refrigerant from a main refrigerant circuit; and a second condenser coil configured to receive a second portion of the refrigerant from the main refrigerant circuit in parallel with the first portion of the refrigerant received by the first condenser coil from the main refrigerant circuit, wherein the second condenser coil is disposed downstream from the first condenser coil relative to a direction of an air flow across the condenser, wherein the first condenser coil comprises a first total length, the second condenser coil comprises a second total length, and the second total length is between 1% and 35% of the first total length.

10. The condenser of claim 9, wherein the first condenser coil comprises:

a first pass configured to desuperheat and condense the first portion of the refrigerant via heat exchange with the air flow; and a second pass in series with the first pass and configured to subcool the first portion of the refrigerant via heat exchange with the air flow.

11. The condenser of claim 10, wherein the first pass includes between 60% and 80% of a total coil size of the first condenser coil.

12. The condenser of claim 10, wherein the second pass includes between 20% and 40% of a total coil size of the first condenser coil.

13. The condenser of claim 9, wherein the first condenser coil includes a first multichannel condenser coil and the second condenser coil includes a second multichannel condenser coil.

14. A condenser, comprising:

a first condenser coil configured to receive a first portion of a refrigerant from a refrigerant conduit; and a second condenser coil configured to receive a second portion of the refrigerant from the refrigerant conduit in parallel with the first portion of the refrigerant received by the first condenser coil, wherein the first condenser coil includes a first coil length and the second condenser coil includes a second coil length, and wherein the second coil length is between 1% and 50% of the first coil length.

15. The condenser of claim 14, wherein the second condenser coil is disposed downstream of the first condenser coil relative to an air flow path through the condenser.

16. The condenser of claim 14, wherein the second coil length is between 1% and 35% of the first coil length.

17. The condenser of claim 14, wherein the first condenser coil includes a refrigerant pass and an additional refrigerant pass in series with the refrigerant pass, wherein the additional refrigerant pass includes an additional pass coil length, and wherein the additional pass coil length is between 90% and 110% of the second coil length.

18. The condenser of claim 17, wherein the refrigerant pass is configured to desuperheat and condense the first portion of the refrigerant via heat exchange with an air flow, and wherein the additional refrigerant pass is configured to subcool the first portion of the refrigerant via heat exchange with the air flow.

19. The condenser of claim 14, wherein the second condenser coil comprises a pass and an additional pass in series with the pass.

20. The condenser of claim 14, wherein the first condenser coil includes a first multichannel condenser coil and the second condenser coil includes a second multichannel condenser coil.

* * * * *